US005522521A

United States Patent [19]

Nagashio

[11] Patent Number: 5,522,521

[45] Date of Patent: Jun. 4, 1996

[54] PULL TAB TYPE BEVERAGE CONTAINER AND METHOD OF MAKING

[76] Inventor: Kichinosuke Nagashio, Ebisu 3-39-2, Shibuya-ku, Tokyo, Japan, 150

[21] Appl. No.: 386,147

[22] Filed: Feb. 8, 1995

[51] Int. Cl.[6] ..... B65D 17/34; B21D 51/44

[52] U.S. Cl. ..... 220/269; 220/270; 220/906; 413/14; 413/16; 413/17

[58] Field of Search ..... 220/269, 270, 220/276, 906; 413/8, 12–17

[56] References Cited

U.S. PATENT DOCUMENTS

| | | | |
|---|---|---|---|
| 3,223,277 | 12/1965 | Zundel | 220/270 |
| 3,308,986 | 3/1967 | Balocca et al. | 220/270 |
| 3,415,411 | 12/1968 | Saunders | 220/270 |
| 3,704,804 | 12/1972 | Kaercher et al. | 220/270 |
| 4,399,925 | 8/1983 | Fundom | 220/269 |
| 4,446,985 | 5/1984 | Dickson | 220/269 |

*Primary Examiner*—Stephen K. Cronin
*Attorney, Agent, or Firm*—Ronald M. Goldman

[57] ABSTRACT

A pull tab type opening device is formed upon an insert metal strip mounted atop the can's lid. The opening device is affixed to and covers an opening in the can's lid by inter-locking rim portions on the strip and lid. Accordingly, the lid may be formed of a less expensive metal, such as steel, while the metal strip, occupying a small portion of the lid, is formed of the more expensive aluminum. Since the percentage of the dissimilar metal, aluminum, in a can is very small in comparison to steel, a used can may thereby be processed as a single metal, steel.

15 Claims, 1 Drawing Sheet

PULL TAB TYPE BEVERAGE CONTAINER AND METHOD OF MAKING

FIELD OF THE INVENTION

This invention relates to an improved pull tab type container of the type principally used to store beverages and, more particularly, to an improved pull tab type beverage can opener that enables the pull tab and can lid to be fabricated of different metals while permitting a used can to be treated as a single metal during recycling.

BACKGROUND

Pull tab type beverage cans offer consumers the convenience of opening a can of stored beverage by simply rotating and/or pulling upon a metal pull tab that is attached to the can's top surface or lid. By eliminating the inconvenience attendant to other kinds of cans that require use of a separate opener, easily opened pull tab type cans, as a consequence, have achieved widespread acceptance. Their use is almost universal.

Such beverage cans are most frequently constructed essentially entirely of aluminum. In other instances, however, pull tab type cans are fabricated with separate parts formed from two different metals, steel and aluminum, as example, in which the cylindrical body portion is formed of sheet steel and the top surface or lid, as variously termed, attached to the top of the cylindrical body, is constructed of aluminum. Such a dual metal can permits the consumer to use the now standard easily operated aluminum pull tab, affixed on the aluminum lid, while retaining the advantage of a less expensive sheet iron for the can's cylindrical body. The present invention addresses the construction of the dual metal type can and, particularly, provides a construction that uses less of the more expensive metal.

Discarded in the rubbish after use, such dual metal type beverage cans are collected and the metals are reclaimed, which is part of the modern trend of recycling. Because the cans are fabricated of significant portions of at least two different metals, which must be processed at the same time, the efficiency of the recycling process is adversly affected.

An object of the present invention, therefore, is to increase the efficiency of metal reclamation of used dual metal type beverage cans and lower the cost of the metal reclamation process.

An additional object of the invention is to reduce the aluminum content of iron-aluminum dual metal type cans and to provide a less expensive structure for a dual metal can.

SUMMARY OF THE INVENTION

In accordance with the foregoing objects, the present invention provides an improved can structure which includes a pull tab type opening device that is constructed upon a separate metal insert strip or plate. That insert metal strip is affixed to the can's lid by interlocking rim portions on the strip and lid, closing a pre-formed passage through the can's lid. By operating the pull tab, an opening is formed through the metal strip into the lid passage to the can's interior that allows the contents of the can to be dispensed.

The foregoing structure enables the lid to be formed of a less expensive metal, such as the steel typically used for a can's cylindrical body, while the insert metal strip holding the pull tab, that occupies only a small portion of the lid, is formed of a different metal, suitably the more expensive aluminum. The resultant dual metal can advantageously contains an increased proportion of the less expensive metal than in prior designs.

A used beverage can may thereby be processed as a single metal, steel, since the percentage of the dissimilar metal, aluminum, is very small in comparison, small enough to be be regarded as a minor impurity in the iron reclamation process.

The foregoing and additional objects and advantages of the invention together with the structure characteristic thereof, which was only briefly summarized in the foregoing passages, becomes more apparent to those skilled in the art upon reading the detailed description of a preferred embodiment, which follows in this specification, taken together with the illustration thereof presented in the accompanying drawings.

DESCRIPTION OF THE PREFERRED EMBODIMENTS

Figure 1:
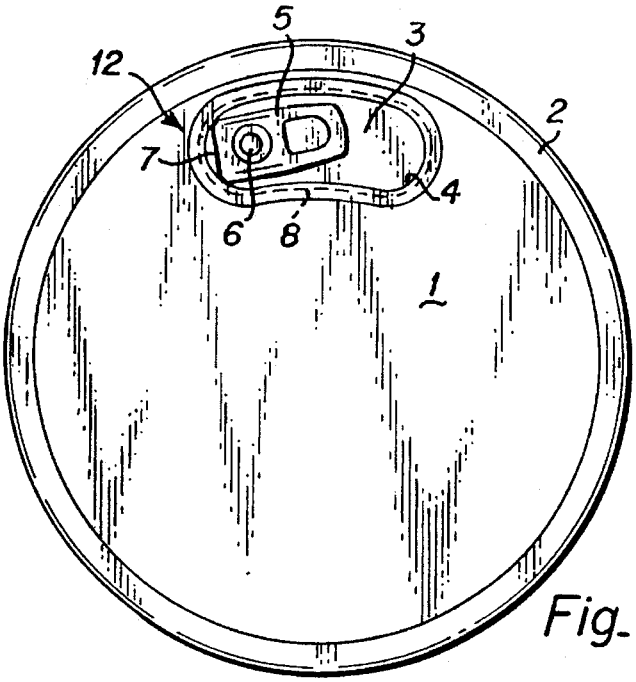
FIG. 1 is a top plan view of a pull tab opener type lid for the can constructed in accordance with the invention.

Reference is made to FIG. 1, which illustrates in top plan view a can lid and tab pull insert for a beverage can that is constructed according to the invention. Lid 1, which serves as the upper portion or top of the beverage can, is formed of sheet steel, a conventional material for this application. That same metal is conventionally used to construct the can's cylindrical body, not illustrated. The lid is circular in shape and is bordered by a peripheral edge or ridge 2, which is rounded in shape for safety to avoid creating a sharp edge. As is conventional, the ridge serves to connect the lid to the underlying cylindrical wall of the can's body with an air tight seal. Since the cylindrical can body is entirely conventional in structure and its description is not necessary to an understanding of the invention, the cylindrical body is not further described or illustrated.

A pull tab insert assembly, generally designated as 12, is is attached to and forms a unitary assembly with lid 1, in an air tight sealed relationship. The pull tab assembly includes an oblong or tongue-shaped plate or strip 3, formed of a thin aluminum plate, an opener tab 5, which is attached to strip 3 by a rivet 6. The tab and rivet are also preferably formed of aluminum. Strip 3 is positioned underlying and closes or covers, as variously termed, a like shaped opening or passage in the surface of lid 1. Such passage is represented by dash lines 8.

Strip 3 includes a cutting line, an indentation or groove 4, created in the lower surface of the strip. The cutting line extends in a path adjacent the peripheral edge of the strip in a closed loop that defines a dispensing opening for the can. As those skilled in the art appreciate, the cutting line may alternately be formed instead in the upper surface of strip 3.

Opener tab 5 contains a pressing and cutting tip 7, which is a conventional pointed tip structure. The cutting tip is oriented so as to press into strip 3 at a position along cutting line 4, when the user, who wishes to open the can, pivots the handle portion of the, counterclockwise in the figure, about rivet 6. In pivoting the opener tab, the cutting tip easily pierces the surface of strip 3.

The cutting line groove 4 reduces the strength of the strip along the groove path and allows a portion of strip 3 to be easily cut by the pull tab and at least partially torn away to open a passage into the can through the overlying opening in the lid when the pull tab is pivoted to cut through strip 3 and then pulled outwardly by the user. That action is better illustrated in the partial cross section view of FIG. 2 to which reference is made.

Figure 2:
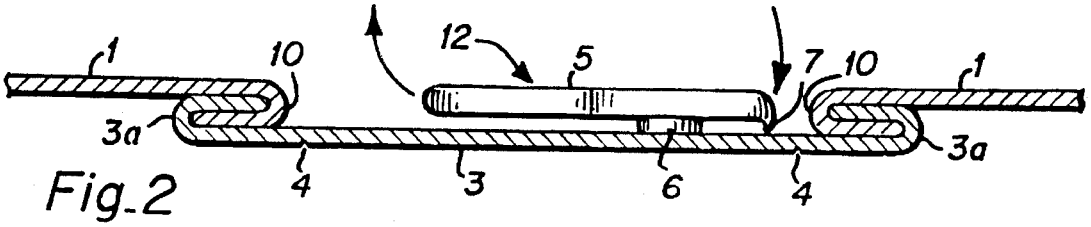
FIG. 2 is a partial cross-section view of the lid assembly of FIG. 1, drawn in an enlarged scale and reversed in direction.

FIG. 2 illustrates the embodiment of FIG. 1 in a side view that is reversed from the view of FIG. 1. As is conventional in easy open cans of this type, pull tab 5 is held by rivet 6 and the cutting edge 7, located to the right in FIG. 2, in a position slightly elevated from the lid's top surface. This permits the user's finger to more easily catch the tab handle, illustrated at the left side in the figure, and raise the tab's end, pivoting the cutting edge 7 about rivet 6 into cutting line 4 or, more accurately stated, into a position on the surface of plate 3 that overlies the cutting line groove located on the underside surface of the plate that defines the cutting line. For purposes of this invention, it is understood that the term cutting line refers to the path defined by the groove, which is the weakened surface portion, and is not limited in meaning to only the groove. Thus the cutting line is accessed from the top side of strip 3, irrespective of whether the groove defining the path is on the top or bottom side of strip 3.

FIG. 2 also illustrates a preferred technique for affixing pull tab assembly 12 to the upper surface of the lid, one that is a mechanical attachment, an additonal feature of the invention. As shown, strip 3 contains a upwardly extending rim or ridge portion, 3*a*, that circumscribes the peripheral edge of the strip. The ridge portion is folded over and extends radially inwardly as appears as a U-shaped or fishhook like geometry in this section view. The lid contains a corresponding depending rim or skirt portion 10 that borders the passage 8 in the surface of lid 1 that is folded over radially outwardly and also appears as a U-shaped or fishhook like geometry in the figure.

As illustrated, ridge portion 3*a* is mechanically interlocked with skirt portion 10. The interlocking ridge and skirt portions are pressed tightly together during assembly to firmly anchor strip 3 and, hence, the entire pull tab assembly 12, to the can lid 1. This interlocking attachment technique forms a fluid tight seal between the pull tab assembly and the lid, preventing any fluid or gases stored in the can from leaking through the border area or interface between those two components.

Figure 1A:
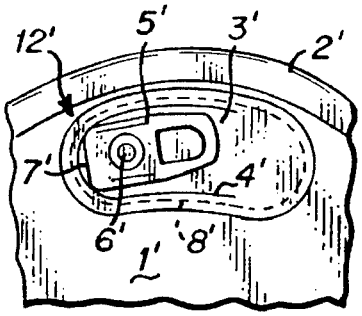
FIG. 1*a* is a partial top plan view of another embodiment of the invention.

In the embodiment of FIG. 1, cutting line 4 is formed in a continuous closed loop, enabling a portion of strip 3 to be severed or torn away from the assembly and separately discarded. In other embodiments, however, the cutting line is simply a horseshoe or U-shaped geometry such as illustrated in the partial top plan view of FIG. 1*a*, which shows an alternative embodiment, with like elements bearing the same numerical designation primed, wherein the groove 4' forms an open loop. Such a U-shaped cutting line path allows the strip portion to be only partially torn away, uncovering the opening in the lid, and preventing the disconnected portion from being entirely removed. The torn section remains with the can and can be discarded only with the can as a unitary assembly after use, as a protection for animal wildlife. Preferably in use, such strip portion, once partially severed, is depressed through the formed opening into the can body, so that the consumer may easily drink stored beverage directly from the opened can.

The foregoing pull tab assembly is readily fabricated and attached to the lid. As illustrated in the partial section view of FIGS. 3, 4 and 5, which are drawn to reduced scale, strip 3 is formed with a ridge portion 3*a* that is upstanding and inwardly tilting, at an angle to the horizontal, and extends about the periphery of the strip, by conventional punching and forming operation. The lid is formed, also suitably by a conventional punching and forming operation, with a downwardly extending rib or skirt portion 10, as variously termed, that extends about the periphery of the opening in lid 1. The skirt portion is tilted or flared outwardly. The length of skirt portion 10 and the length of ridge portion 3*a* are essentially equal.

Figure 3:
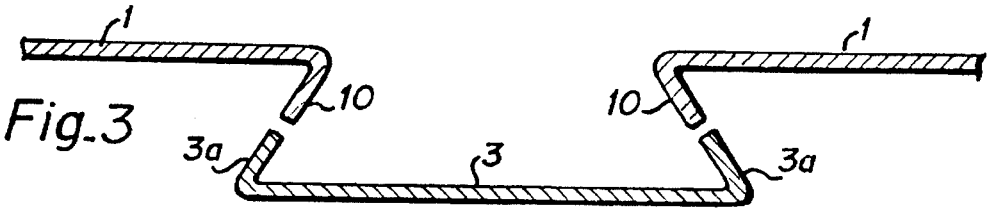
FIG. 3 is a cross sectional view of a section of the can lid and the tongue shaped plate or strip that carries the pull tab, illustrating the geometric relationship between those components as prepared for assembly in accordance with the novel fastening arrangement, drawn to a slightly reduced scale from that in FIG. 2.
Figure 4:
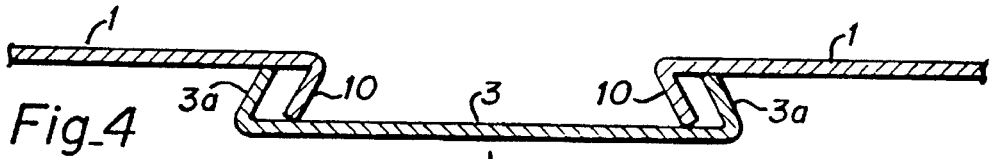
FIG. 4 is a cross sectional view of the component parts of the can lid and tongue shaped plate of FIG. 3 as placed in contact with one another during a preliminary stage of fabrication.

As shown in FIG. 3 the outward tilt or flare angle between skirt portion 10 and the horizontal is the same as the inward tilt or incline angle of ridge portion 3*a*. The edge of ridge portion 3*a* defines a perimeter slightly larger in size and of the same essential shape as the perimeter defined by the edge of skirt portion 10 surrounding the opening in the lid. With the edges of the respective ridge and skirt portions oriented facing the opposite surface, the lid and plate elements are moved into contact with one another as illustrated in FIG. 4 with plate 3 covering the opening in the lid.

Ridge portion 3*a* covers a slightly larger area than defined by skirt portion 10 and is of like geometry. When the two components are assembled the skirt portion fits within the area encompassed by ridge portion 3*a*. As illustrated skirt portion 10 is slightly spaced from the corresponding ridge 3*a* and is inclined at the same angle, forming a small parallelogram section in the plane of the paper, the tip of the rim portion of one element abutting the surface of the opposed surface. The elements are ready for further fabrication illustrated in FIG. 5.

Figure 5:
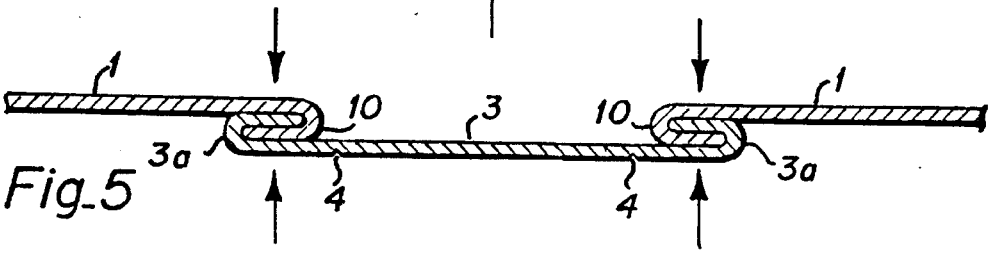
FIG. 5 is a cross-sectional view of FIG. 4 after the tongue shape plate is attached and sealed to the lid.

In the next step of FIG. 5, cutting line 4 is scored into the surface of the aluminum strip as the two surfaces are pressed together in a conventional burring process with pressure applied as indicated by the arrows to collapse and fold over the respective skirt and ridge, firmly interlocking the two portions together. With the aluminum strip so attached to the lid, the tab and rivet are attached to the aluminum strip using conventional processes to complete the lid assembly. The lid may then be used to seal a can which has been filled with a beverage. It is noted that strip 3 may alternately be positioned on the top side of the lid, in which construction, strip 3 overlies the opening in the lid. However, since the illustrated arrangement is believed to possess greater strength, the illustrated structure is preferred.

Although the lid is attached by means of the mechanical interlocking or crimping process illustrated in the preceding figures and previously discussed, any other industrially acceptable attachment technique may be substituted, all of which come within the scope of the present invention. As example, the pull tab assembly may be attached to the lid by conventional solder, according to conventional soldering processes, or by means of a weld, accordance with conventional welding processes.

Since the surface area of the aluminum tongue-shaped strip 3 and, incidentially the area of the underlying lid passage, represents only a very small fraction of the surface area of the lid, and an even smaller part of the entire can, suitably occupying no more than about sixteen per cent of the area of lid 1, the small amount of aluminum present in the steel can does not create problems during recycling processing. Further the material cost for the lid assembly is also low. And only a few extra steps are required in fabrication.

Preferably pull tab 5 and rivet 6 are also formed of aluminum, which permits well established fabrication procedures to be used. However, if it is desired to further reduce the aluminum content one may instead use steel for the fabrication of those pull tab elements as well.

It should be appreciated that the pull tab assembly and the corresponding opening in the lid may be located in the center of the lid or any other location on the top surface. Indeed, a single practical embodiment of the pull tab assembly may be used with lids having the lid opening placed anywhere on the upper surface of the lid, which avoids the need to redesign the tab assembly each time a different location is specified by the can designer. However for convenience to permit users to drink directly from the can, a location along the lid's edge, as illustrated in FIG. 1, is preferred.

Although not earlier mentioned, it should be noted the metals used in cans of the foregoing type often contain very thin platings of other metals or coatings of plastic materials. These are included to minimize chemical reaction of the stored consumable with the principal metal of the can and/or to enhance the air tightness of the can for longer storage life. Thus when reference is made in this specification and claims to the metal of the can, the metal of the lid and the metal strip portion of the pull tab assembly, it should be understood that such is not intended to exclude or preclude use of such coatings on the can or lid metal or metal strip portion, even though such conventional coatings and platings are not separately illustrated or described, since such description and illustration are not necessary to an understanding of the invention. To the contrary, the metal of the can, lid and strip portion of the pull tab assembly may be regarded as including one or more thin layers of plating and/or coatings and all such additions are within the scope of the present invention. And while 1 use the term steel to describe the less expensive metal used for the cylindrical body of the container, it is understood that sheet iron is included within the meaning of that term.

It is appreciated that metal cans constructed in accordance with the foregoing description are suited for storage of carbonated beverages and sodas, alcoholic beverages, such as beer, and non-carbonated drinks, such as coffee.

It is believed that the foregoing description of the preferred embodiments of the invention is sufficient in detail to enable one skilled in the art to make and use the invention. However, it is expressly understood that the detail of the elements presented for the foregoing purposes is not intended to limit the scope of the invention, in as much as equivalents to those elements and other modifications thereof, all of which come within the scope of the invention, will become apparent to those skilled in the art upon reading this specification. Thus the invention is to be broadly construed within the full scope of the appended claims.

What is claimed is:

1. A lid for sealing to and closing a can, said lid having a passage and a pull tab for opening said passage and further comprising:

a plate located on said lid for closing said lid passage, said plate including a cutting line; and wherein said pull tab is affixed to said plate for cooperative engagement with said cutting line to open a passage through said plate and open said lid passage; said lid includes a rim portion surrounding said lid passage, said plate includes a rim portion circumscribing a peripherial edge thereof, said rim portion of said lid being folded over and extending radially outwardly from said lid passage and said rim portion of said plate being folded over and extending radially inwardly toward said lid passage, said plate portion being received between said lid rim portion and said lid in compressive engagement for affixing said plate to said lid and sealing said lid passage.

2. The invention as defined in claim 1, wherein said plate comprises a tongue shape.

3. The invention as defined in claim 1, wherein said lid comprises steel and wherein said plate comprises aluminum.

4. The invention as defined in claim 3, wherein said plate comprises a surface area no larger than sixteen per cent of said said lid.

5. A metal container having a pull tab opener, said container having a principal body portion and a lid portion sealed to said principal body portion;

said lid portion defining an upper surface to said container of a first predetermined area and including a lid passage through said upper surface of a second predetermined area;

a pull tab assembly, said pull tab assembly being affixed in sealed engagement to said lid portion and covering said lid opening to seal said upper surface;

said pull tab assembly, including:

a plate defining a third predetermined surface area, said third predetermined area being slightly greater than said second predetermined area;

a pull tab affixed atop said plate; and said plate containing a cutting line groove in a surface of said plate with said cutting line groove defining a loop path in aligned relationship with said lid passage;

said pull tab being operative to cut through said plate along said cutting line to produce a dispensing passage through said lid passage; and wherein said lid portion includes a rim portion surrounding said lid passage, wherein said plate of said pull tab assembly includes a rim portion circumscribing a peripherial edge thereof, said rim portion of said lid being folded over and extending radially outwardly from said lid passage and said rim portion of said pull tab assembly being folded over and extending radially inwardly toward said lid passage said plate rim portion being received between said lid rim portion and said lid surface in compressive engagement for affixing said pull tab assembly to said lid portion.

6. The invention as defined in claim 5, wherein said principal body portion comprises a cylindrical shape and wherein said lid portion comprises a circular disk shape.

7. The invention as defined in claim 5, wherein said cutting line groove loop path extends about the entire periphery of said plate to define a closed loop.

8. The invention as defined in claim 5, wherein said cutting line groove loop path extends about a portion of the periphery of said plate to define an open horse shoe shaped loop.

9. The invention as defined in claim 5, wherein said pull tab includes a rivet to hold said pull tab to said plate to permit the user to pivot said pull tab, and a cutting edge on an end of said pull tab, said cutting edge adapted to intersect a portion of said cutting line responsive to pivotal movement of said pull tab.

10. The invention as defined in claim 5, wherein said principal body portion and said lid portion comprises a first metal and said plate comprises a second metal.

11. The invention as defined in claim 10, wherein said third predetermined surface area of said plate is no greater than sixteen per cent of said first predetermined surface area of said upper surface.

12. The invention as defined in claim 10, wherein said first metal comprises steel and wherein said second metal comprises aluminum.

13. The invention as defined in claim 10, wherein said first metal comprises sheet steel and wherein said second metal comprises aluminum.

14. The invention as defined in claim 13, wherein said plate comprises a tongue shape.

15. A method of fabricating a pull tab type can comprising:

forming from a first material a lid having a first predetermined area and an opening therethrough of a second predetermined area with a first rim portion radially outwardly extending therefrom to define a first perimeter about said opening;

forming from a second material a plate having a second rim portion radially inwardly extending therefrom to define a second perimeter, said second perimeter being slightly larger than said first perimeter, said plate having a surface area greater than the corresponding surface area of said opening in said lid;

placing said rim portion of said plate in facing relationship with said rim portion of said lid with said respective rims of said lid and plate contacting said plate and lid, respectively, to engage said lid and plate with said plate covering said opening in said lid;

swagging said plate and said lid to fold over said rim portions in interlocking relationship and to form a cutting line into said plate; and assembling a pull tab to said plate.

* * * * *